United States Patent [19]

Balash et al.

[11] Patent Number: 4,477,700

[45] Date of Patent: Oct. 16, 1984

[54] TACTILE MEMBRANE KEYBOARD WITH ELLIPTICAL TACTILE KEY ELEMENTS

[75] Inventors: Frederick A. Balash, Mesa; Mary T. Caton, Chandler, both of Ariz.

[73] Assignee: Rogers Corporation, Rogers, Conn.

[21] Appl. No.: 551,470

[22] Filed: Nov. 14, 1983

[51] Int. Cl.[3] ..... H01H 1/00; H01H 13/70

[52] U.S. Cl. ..... 200/5 A; 200/159 B; 200/275

[58] Field of Search ..... 200/5 R, 5 A, 86 R, 200/67 DA, 67 DB, DIG. 001, 159 B, 275, 292

[56] References Cited

U.S. PATENT DOCUMENTS

| | | | |
|---|---|---|---|
| 3,643,041 | 2/1972 | Jackson | 200/5 A |
| 3,860,771 | 1/1975 | Lynn et al. | 200/5 A |
| 3,898,421 | 8/1975 | Suzumura | 200/159 B |
| 3,930,083 | 12/1975 | Pinkham | 200/5 A |
| 4,096,364 | 6/1978 | Lynn et al. | 200/5 A |
| 4,127,758 | 11/1978 | Lowthorp | 200/DIG. 001 X |
| 4,128,744 | 12/1978 | Seeger | 200/292 X |
| 4,190,748 | 2/1980 | Langford | 200/5 A |
| 4,245,138 | 1/1981 | Harper | 200/292 X |
| 4,307,268 | 12/1981 | Harper | 200/5 A |
| 4,314,116 | 2/1982 | Gordon | 200/159 B X |
| 4,322,587 | 3/1982 | Burns et al. | 200/159 B X |

FOREIGN PATENT DOCUMENTS

| | | | |
|---|---|---|---|
| 2432205 | 3/1980 | France | 200/159 B |
| 2442502 | 7/1980 | France | 200/5 A |
| 2071420A | 9/1981 | United Kingdom | 200/159 B |

*Primary Examiner*—J. R. Scott

*Attorney, Agent, or Firm*—Fishman & Dionne

[57] ABSTRACT

A tactile or snap action membrane keyboard is presented wherein the tactile or snap action key elements are protrusions in a membrane sheet, each protrusion having a flat elliptical top surface or plateau with a plurality of inclined ramps from the base sheet to the plateau.

11 Claims, 5 Drawing Figures

TACTILE MEMBRANE KEYBOARD WITH ELLIPTICAL TACTILE KEY ELEMENTS

BACKGROUND OF THE INVENTION

This invention relates to the field of tactile or snap action keyboards. More particularly, this invention relates to the field of tactile or snap action elements which are in the form of protrusions in a plastic sheet. As is well known in the art of tactile or snap action membrane keyboards, tactile or snap action protrusions may be formed in a sheet of Mylar (a trademark of E.I. DuPont DeNamours and Co.) material or other suitable plastic material. The protrusions are sometimes referred to as ", although several different geometric configurations of the "bubbles" are known in the art. By way of example, U.S. Pat. No. 3,643,041 to Jackson discloses a snap action keyboard in which the protrusions are in the form of semi-spherical domes; U.S. Pat. No. 3,860,771 to Lynn et al shows a snap action keyboard in which the key elements are in the form of semi-spherical domes located on top of cylindrical pedestals; and U.S. Pat. No. 4,190,748 to Langford discloses a tactile keyboard in which the tactile key elements are in the form of truncated cones, i.e., cone segments having a flat top surface or plateau. While those three patents are by no means a complete list of all prior art in the field of tactile keyboard elements, they do illustrate what are believed to be the most commonly used geometric configurations for these tactile key elements.

Although the geometric configurations of the tactile key elements are different in the three patents cited above and other geometric configurations may exist, a characteristic believed to be common to almost all geometric configurations of tactile key elements is that they are symmetrical. Thus, in the three patents identified above, the tactile key elements are, when viewed in any regular cross section, symmetric with respect to a center axis through the elements and the tactile elements are also symmetric surfaces of revolution about their center axes. As stated, this characteristic of symmetry (either in cross section or in surface of revolution) is believed to be incorporated in almost all tactile or snap action key elements of membrane type keyboards.

A problem often encountered with prior art tactile or snap action membrane keyboards is that the consistency of snap action or tactile feel (or tactile feedback as it is sometimes called) may be very sensitive to the place and manner of application of the actuating force. Many of these snap action protrusions or bubbles require actuation essentially at the center of the bubble to obtain proper and consistent snap action, while others, such as the configuration shown in Langford U.S. Pat. No. 4,190,748, may be actuated at an off center design location; but in all cases, the quality and consistency of snap action is very sensitive to the location at which the actuating force is applied. If the actuating force is not applied within the design tolerances of the actuating point, or if the location of the actuating force is applied inconsistently, inconsistent and often unacceptable (sometimes bordering on nonexistent) snap action or tactile feel may result. As a result of this sensitivity of prior art snap action key elements to the location of the actuating forces, prior art keyboards of this type have been very sensitive to manufacturing and assembly tolerances; and unacceptable products may result if manufacturing tolerances or alignment tolerances in assembly are exceeded. These problems are particularly present with requirements for large key areas or out of the ordinary key shape areas. The problem of obtaining consistent tactile response when such keys (i.e., large or unordinarily shaped) are actuated at various points of the keys is particularly acute.

One approach to the problem of key sensitivity to the point of application of the actuating force is disclosed in U.S. application Ser. No. 352,310 (assigned to Flex-Key Corporation, a subsidiary of the assignee hereof). The tactile keyboard of U.S. application Ser. No. 352,310 has asymmetric tactile or snap action key elements in a membrane type keyboard. The asymmetric tactile or snap action key elements of that application do not have the sensitivity of other prior art key elements to location of the actuating force.

SUMMARY OF THE INVENTION

The tactile keyboard of this invention has keys formed in a membrane sheet which are elliptical in shape and have a plurality of inclined ramps around the key. More specifically, each key is a protrusion having a flat elliptical top surface or plateau. Each key also has four ramps from the membrane sheet to the plateau, at the major and minor axes of the ellipse.

A keyboard having keys according to this invention provides tactile feel for large key areas or out of the ordinary shaped key areas regardless of the point of application of actuating force.

BRIEF DESCRIPTION OF THE DRAWINGS

Referring now to the drawings, wherein like elements are numbered alike in the several FIGURES:

FIG. 1(*b*) is a sectional view taken along line (b)—(b) of FIG. 1(*a*).

FIG. 1(*c*) is a sectional view taken along line (c)—(c) of FIG. 1(*a*).

FIG. 1(*d*) is a sectional view taken along line (d)—(d) of FIG. 1(*a*).

DESCRIPTION OF THE PREFERRED EMBODIMENT

Figure 1A:
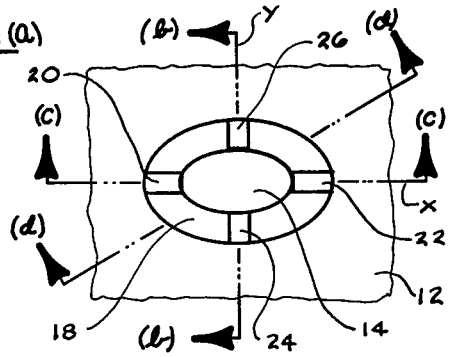
FIG. 1(*a*) is a perspective view of an elliptical flat topped membrane key element in accordance with the present invention.
Figure 1C:
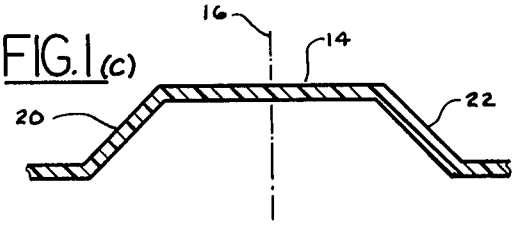
Figure 1B:
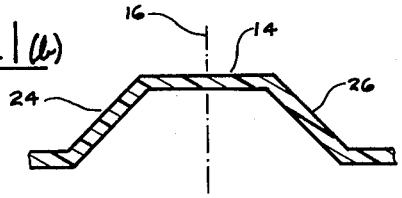
Figure 1D:
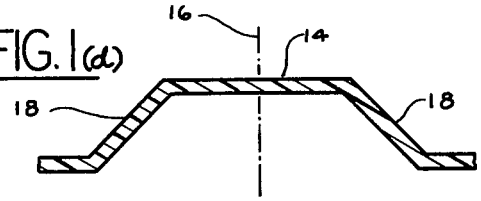

Referring first to the series of FIGS. 1(*a*) through 1(*d*), a single snap action or tactile bubble or key is shown. The bubble, indicated generally at 10, is in the form of a protrusion from a base sheet 12 of plastic material, preferably polyester Mylar, or other suitable flexible plastic material. The plastic key 10 is a modified version of the snap action projections of U.S. Pat. No. 4,190,748 (identified as item 28 in that patent). The projections in that prior patent were in the form of a trucated right circular cone having a flat top and conical side walls and being symmetric about the vertical center axis. The snap acting keys of the present invention differ in that they have an elliptical flat top or plateau on a conformingly shaped side wall in which ramps are formed; and the keys of this invention are not symmetric about the vertical axis.

The key 10 has a flat top surface or plateau 14 which is parallel to base sheet 12. Plateau 14 is elliptical with a major axis x and a minor axis y. Axes x and y intersect at the center of generation of the ellipse, which may be viewed as a vertical axis or projection axis 16. The key has a curving side wall 18 which extends from base sheet 12 to flat top 14 and conforms to the particular elliptical shape selected for plateau 14.

Side wall 18 has a first pair of flat ramps 20 and 22 cut across curved side surface 18 at the opposite ends of major axis x and a second pair of flat ramps 24 and 26 cut across curved side surface 18 at the opposite ends of minor axis y.

Key 10 is elliptical, and hence asymmetrical, about axis 16 perpendicular to surface 14.

The particular asymmetric configuration shown and described with respect to FIGS. 1(*a*) to 1(*d*) is a presently preferred configuration with the ramps at the end of the major and minor axes x and y. However, it is to be understood that other configurations are within the scope of the present invention wherein the top surface or plateau is elliptical but the ramps are not all necessarily on major or minor axes. The important point is that the bubble or key structure be intentionally constructed to have a flat elliptical top and to have flat ramps preferably at the ends of the major and/or minor axes.

The key configuration of this invention is intended for large or irregularly shaped key areas in a keyboard. Thus, it is expected the key would range in size from at least about 0.600 inch (total dimension in the direction of the x axis) and at least about 0.300 inch (total dimension in the y axis direction) or that the flat ellipse area 14 would have minimum dimensions of 0.400 inch for the x axis and 0.130 inch for the y axis.

While the ramps have been shown on the major and minor axes of the ellipse, the ramps could be located off those axes, and the total number of ramps could range from two to six ramps per dome, depending on requirements and response characteristics desired.

Keys constructed in accordance with this invention have a consistent snap action or tactile feel over the entire large area of the key even though the actuating force may not be applied consistently at the intended point of force application for proper actuation of the key. This consistency of actuation and tactile feel is particularly important in keyboard structures where the keyboard has a flat overlay surface to which the actuating force is applied, and the key areas are large and/or irregularly shaped. The use of key structure in accordance with the present invention results in a keyboard in which snap action is consistent for keys of large and/or irregular areas where inconsistent application of actuating force occurs. The structure of the present invention also reduces the need to be concerned about precise alignment in assembly of the keyboards, because key actuation remains relatively consistent even though the various parts of the keyboard structure may not be precisely aligned.

Figure 2:
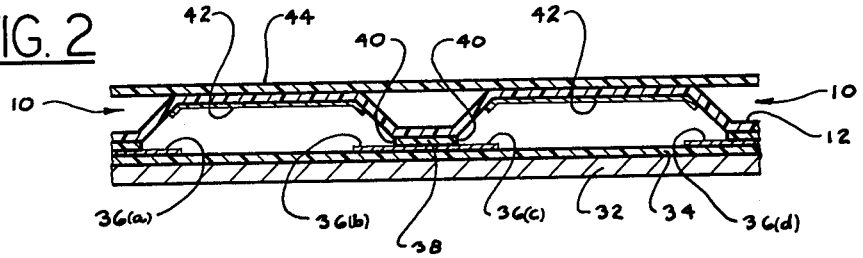
FIG. 2 is a partial sectional elevation view of a keyboard construction incorporating and in accordance with the present invention.

Referring now to FIG. 2, a keyboard configuration is shown incorporating the structure of the present invention. It will be understood that the structure shown in FIG. 2 is only a partial elevation view of a keyboard assembly, with details such as case or bezel and mechanical and electrical interconnections not being shown because they are not needed to understand the structure and operation of the present invention. The keyboard assembly of FIG. 2 has a rigid back or reinforcing board 32 which may be hard plastic such as Bakelite, fiberboard or other suitable support material. A layer of flexible plastic insulating material 34, such as Mylar or other suitable insulating material, is positioned on one side of backing board 32 and may be adhered to the backing board. Conductive circuit patterns 36(*a*) through 36(*d*), such as copper or conductive ink (which may be formed by printed circuits or other techniques), are on the top side of insulating layer 34; the plastic sheet 34 and conductive patterns 36(*a*) through 36(*d*) being, in effect, a unitary layer of printed circuitry. It will be observed that portions of two conductive circuit patterns extend under each key to be electrically connected by actuation of the bubble or key. A plastic spacer 38 is positioned on top of insulating sheet 34, and spacer 38 may be adhered to sheet 34. Plastic spacer 38 (which may also be Mylar) has a series of elliptical openings 40, each of which is aligned with a pair of circuit lines (such as lines 36(*a*) and 36(*b*) and with an associated key element 10. The key elements 10 are each formed out of sheets 12 in accordance with the structure and explanation previously set forth with regard to FIGS. 1(*a*) through 1(*e*). Each key 10 has an electrically conductive shorting element 42 (such as conductive ink or copper) on its undersurface beneath the elliptical top portion 14. Sheet 12 is initially a flat piece of flexible printed circuitry having the shorting elements 42 thereon. The bubbles or keys may be formed with shaping tooling under heat and pressure by techniques known in the art. Flat portions of sheet 12 may be adhered to spacer sheet 38.

A flat cover or overlay sheet 44 may be located and positioned to be in contact with the flat top portion 30 of each asymmetric key 10, and the upper portion of overlay sheet 44 (i.e., the side not in contact with the keys) may have numbers, letters or other key identifying indicia thereon to be read by the user of the keyboard.

Key 10 and its associated circuitry on sheet 34 constitute, in effect, a key station. In operation of the keyboard of FIG. 2, the user locates the particular key station which is desired to be actuated (such as by reading the indicia on the top of sheet 44). The user then pushes downwardly on that key to bring a shorting element 42 into contact with a pair of circuit patterns, such as 36(*a*) and 36(*b*) to interconnect those circuit patterns and generate an electrical signal from the keyboard. When the downward force is applied to a key 10, the key collapses downwardly with a snap action and tactile feel or tactile feedback to the user. As has been previously stated, because of the elliptical key configuration of the present invention, the snap action and tactile feedback remain relatively consistent notwithstanding the large area or irregular area of each key which may be indicated on the overlay sheet 44 and notwithstanding inconsistency in the location or direction of the actuating force applied to a particular key and notwithstanding minor misalignments in the structure of the keyboard assembly.

It will be understood that the features and advantages of the asymmetric key configuration generally described above are realized in all of the various keyboard structures shown in FIGS. 2–5 and may also be realized in other variance of these keyboard structures, all of which are deemed to be within the scope of the present invention.

While preferred embodiments have been shown and described, various modifications and substitutions may be made thereto without departing from the spirit and scope of the invention. Accordingly, it is to be understood that the present invention has been described by way of illustrations and not limitation.

What is claimed is:

1. A tactile snap action switch element comprising:
a sheet of base material; and
at least one snap action protrusion formed in said sheet of base material, said protrusion being elliptical.

2. A tactile snap action switch element as in claim 1 wherein:
said protrusion has a flat elliptical top surface, and a plurality of ramps from said base sheet to said flat top.

3. A tactile snap action switch element as in claim 2 wherein:
said ramps are at the major and minor axes of said elliptical top surface.

4. A tactile snap action switch element as in claim 1 wherein:
said protrusion has a flat elliptical top, a curved side wall between said sheet of base material and said flat top, and a plurality of ramps in said side wall.

5. A tactile snap action switch element as in claim 4 wherein:
said ramps intersect said flat elliptical top at the major and minor axes thereof.

6. A keyboard comprising:
a sheet of base material;
a plurality of tactile elements formed in said sheet of base material, each of said tactile elements being an elliptical protrusion in said base material asymmetric with respect to a line or plane of reference;
first electrically conductive means associated with each tactile element; and
second electrically conductive means aligned with each of said tactile elements, said first electrically conductive means contacting said second electrically conductive means to complete an electric circuit upon actuation of each of said tactile elements.

7. A keyboard as in claim 6 wherein:
each of said tactile elements has a flat elliptical top surface and a plurality of ramps from said base sheet to said flat top.

8. A keyboard as in claim 6 wherein:
said ramps are at the major and minor axes of said elliptical top surface.

9. A keyboard as in claim 6 wherein:
each of said tactile elements has a first section in the shape of a portion of a truncated cone, and at least one second section in a shape different from said first section.

10. A keyboard as in claim 9 wherein:
said ramps intersect said flat elliptical top at the major and minor axes thereof.

11. A keyboard as in claim 6 including:
an insulating spacer sheet between said sheet of base material and said second electrically conductive means;
said insulating spacer having a plurality of elliptical openings aligned with each of said tactile elements.

* * * * *